US011204023B2

(12) United States Patent
Chou et al.

(10) Patent No.: US 11,204,023 B2
(45) Date of Patent: Dec. 21, 2021

(54) POSITIONING STRUCTURE OF MOTOR OF AIR COMPRESSOR

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 29 days.

(21) Appl. No.: 16/706,781

(22) Filed: Dec. 8, 2019

(65) Prior Publication Data

US 2021/0172427 A1 Jun. 10, 2021

(51) Int. Cl.

| | |
|---|---|
| ***F04B 35/04*** | (2006.01) |
| ***F04B 39/00*** | (2006.01) |
| ***F04B 39/12*** | (2006.01) |
| ***F04B 53/14*** | (2006.01) |
| ***F04B 53/22*** | (2006.01) |
| ***F04B 39/14*** | (2006.01) |
| ***F04B 53/00*** | (2006.01) |

(52) U.S. Cl.

CPC ..... *F04B 35/04* (2013.01); *F04B 39/0005* (2013.01); *F04B 39/12* (2013.01); *F04B 39/14* (2013.01); *F04B 53/006* (2013.01); *F04B 53/144* (2013.01); *F04B 53/22* (2013.01)

(58) Field of Classification Search

CPC ..... F04B 35/04; F04B 53/22; F04B 53/144; F04B 39/14; F04B 53/006; F04B 35/00; F04B 39/121; F04B 41/00; F04B 53/16; H02K 5/04; H02K 2205/00; H02K 5/00–26; H02K 15/00–14; F05B 2210/12; F05B 2210/16; F05B 2260/30; F05B 2260/4031

See application file for complete search history.

(56) References Cited

U.S. PATENT DOCUMENTS

| | | | | |
|---|---|---|---|---|
| 5,620,311 | A * | 4/1997 | Wetzel | B60T 8/4022 417/415 |
| 8,629,583 | B2 * | 1/2014 | Bernhardt | H02K 9/14 310/50 |
| 2003/0107284 | A1 * | 6/2003 | Wickham | H02K 5/00 310/91 |
| 2005/0063840 | A1 * | 3/2005 | Chou | F04B 39/122 417/415 |
| 2014/0158131 | A1 * | 6/2014 | Kenyon | A61M 16/0066 128/204.18 |
| 2015/0330379 | A1 * | 11/2015 | Chou | F16F 15/262 417/374 |
| 2018/0223824 | A1 * | 8/2018 | Inoue | F04B 1/145 |

* cited by examiner

*Primary Examiner* — Charles G Freay
*Assistant Examiner* — Chirag Jariwala

(57) ABSTRACT

A positioning structure of a motor of an air compressor contains: a base, a cylinder, the motor, and a transmission mechanism. The base includes a first locating orifice and a second locating orifice. The cylinder includes an air storage seat. A small-diameter gear is fitted on the motor via the first locating orifice. A bearing housing of the motor is accommodated in the first locating orifice. The transmission mechanism actuates a piston to move in the cylinder reciprocately. The base includes two symmetrical elongated plates having two hooks respectively and includes two symmetrical arcuate retainers. An outer wall of the motor is retained by the two symmetrical arcuate retainers, and the two hooks are engaged with the magnetic coil.

8 Claims, 10 Drawing Sheets

POSITIONING STRUCTURE OF MOTOR OF AIR COMPRESSOR

FIELD OF THE INVENTION

The present invention relates to a positioning structure of a motor of an air compressor which is capable of fixing the motor on the base without using any screw(s).

BACKGROUND OF THE INVENTION

Referring to FIGS. 7 and 8, a conventional air compressor 1 is mounted on a vehicle and contains a base 11, a cylinder 12 connected on the base 11, a motor 13 fixed on the base 11, and a piston 14 driven by the motor 13 to move in the cylinder 12 reciprocately so as to draw, compress, and discharge air.

The motor 13 is fixed on the base 11 by using multiple screws 15. However, the multiple screws 15 are removed easily after a period of using time.

As illustrated in FIGS. 9 and 10, when a length of the cylinder 12 of the air compressor 1 is too long, the motor 13 cannot be fixed on the base 11 because of a limited space. In other words, the motor 13 cannot be fixed on the base 11 by using the multiple screws 15.

The present invention has arisen to mitigate and/or obviate the afore-described disadvantages.

SUMMARY OF THE INVENTION

The primary aspect of the present invention is to provide a positioning structure of a motor of an air compressor which is capable of fixing the motor on the base without using any screw(s).

In operation, the multiple through orifices of the front face are engaged on the multiple posts of the base individually, and the bearing housing of the front face of the motor is received in the first locating orifice of the base, wherein an outer wall of the motor is retained by the two symmetrical arcuate retainers of the base. In the meantime, an end of the motor, fitted with the magnetic coil, abuts against two top faces of the two symmetrical arcuate retainers, and the two hooks of the two symmetrical elongated plates of the base are engaged with the motor, thus fixing the motor on the base securely.

DETAILED DESCRIPTION OF THE PREFERRED EMBODIMENTS

Figure 1:
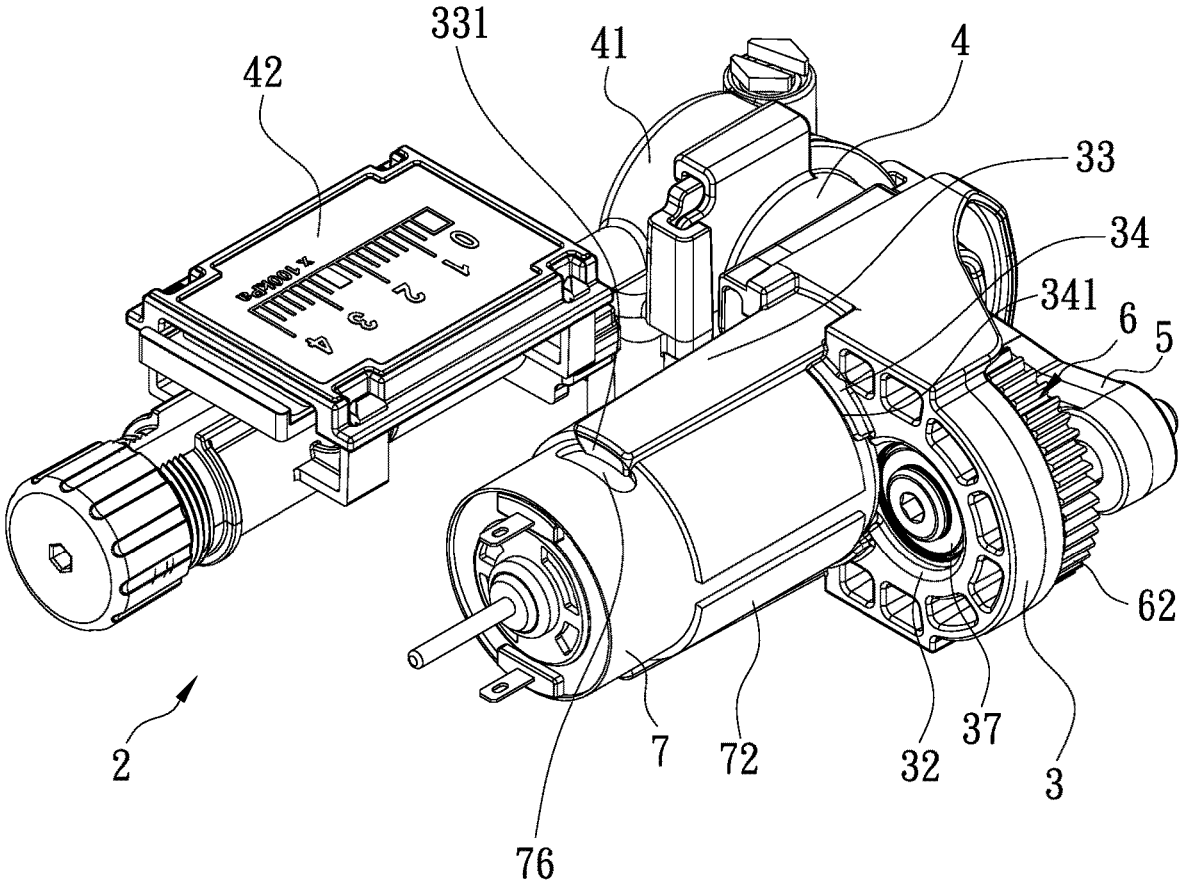
FIG. 1 is a perspective view showing the assembly of an air compressor according to a first embodiment of the present invention.
Figure 2:
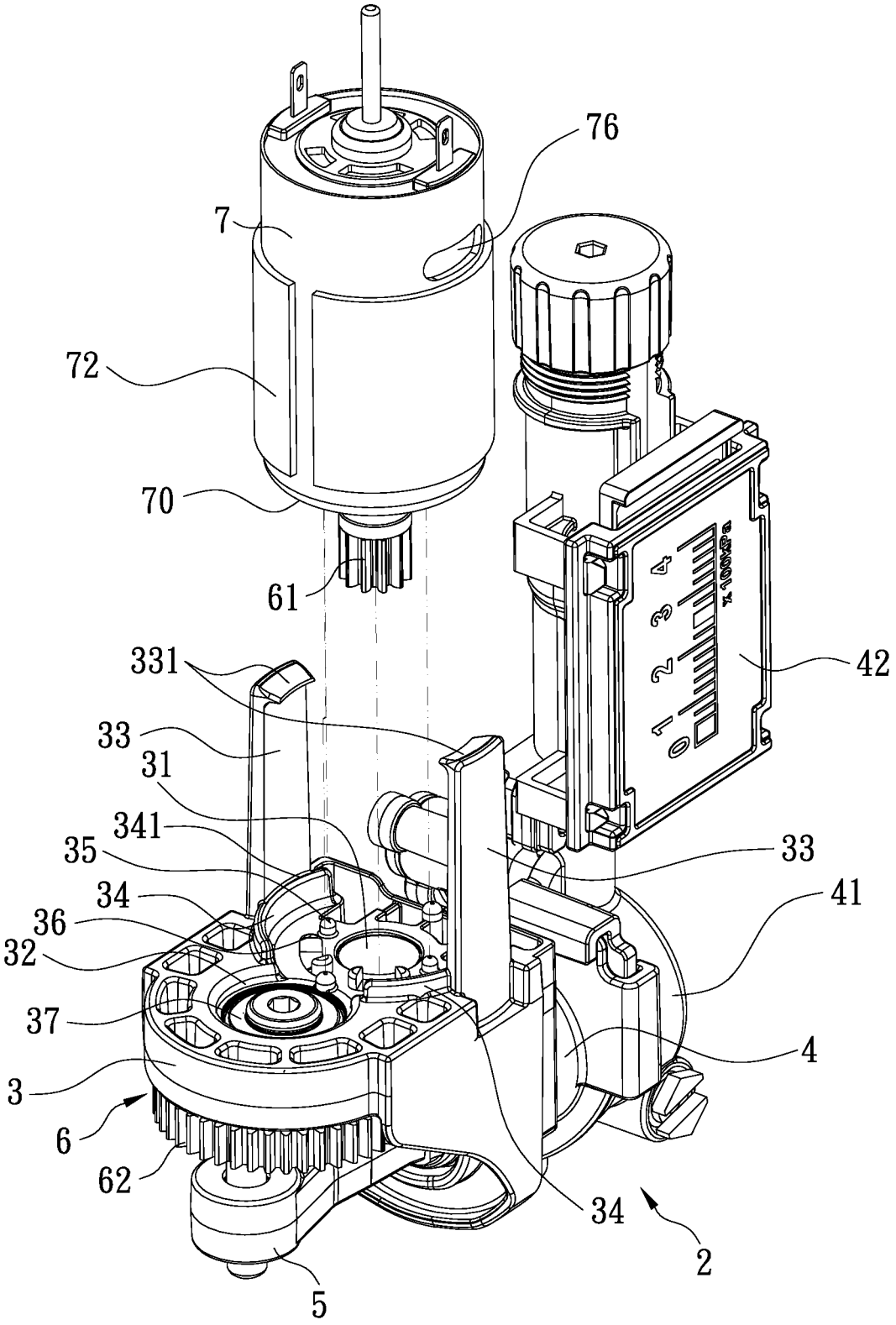
FIG. 2 is a perspective view showing the exploded components of the air compressor according to the first embodiment of the present invention.
Figure 3:
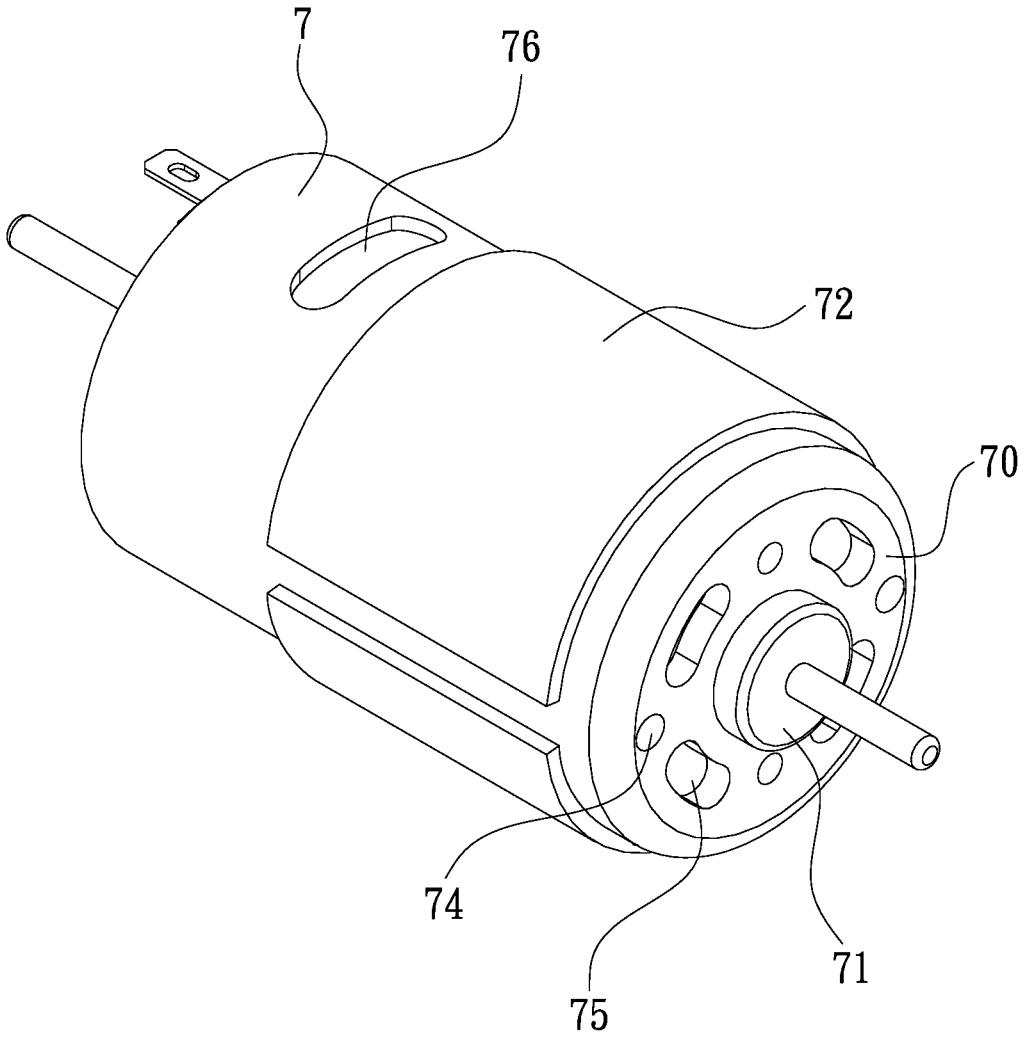
FIG. 3 is a perspective view showing the assembly of a part of the air compressor according to the first embodiment of the present invention.

With reference to FIGS. 1-3, a positioning structure of a motor 7 of an air compressor 2 according to a first embodiment of the present invention, the air compressor 2 comprises: a base 3, a cylinder 4 connected on the base 3, the motor 7 fixed on the base 3, and a piston 5 driven by the motor 7 to move in the cylinder 4 reciprocately.

The base 3 includes multiple locating orifices which are a first locating orifice 31 and a second locating orifice 32, wherein a small-diameter gear 61 is inserted through the first locating orifice 31 to fit on a central shaft of the motor 7, and a bearing housing 71 of the motor 7 is accommodated in the first locating orifice 31, a diameter A of a top of the small-diameter gear 61 is less than an outer diameter B of the bearing housing 71, and the second locating orifice 32 accommodates a bearing 37. The motor 7 includes a magnetic coil 72 made of metal and configured to conduct magnetism so as to enhance operating efficiency of the motor 7.

The cylinder 4 is one-piece or is movably connected on the base 3, and the cylinder 4 includes an air storage seat 41, an air pipe connected with the air storage seat 41 and configured to delivery air, and a pressure gauge 42 coupled on the air storage seat 41.

Figure 5:
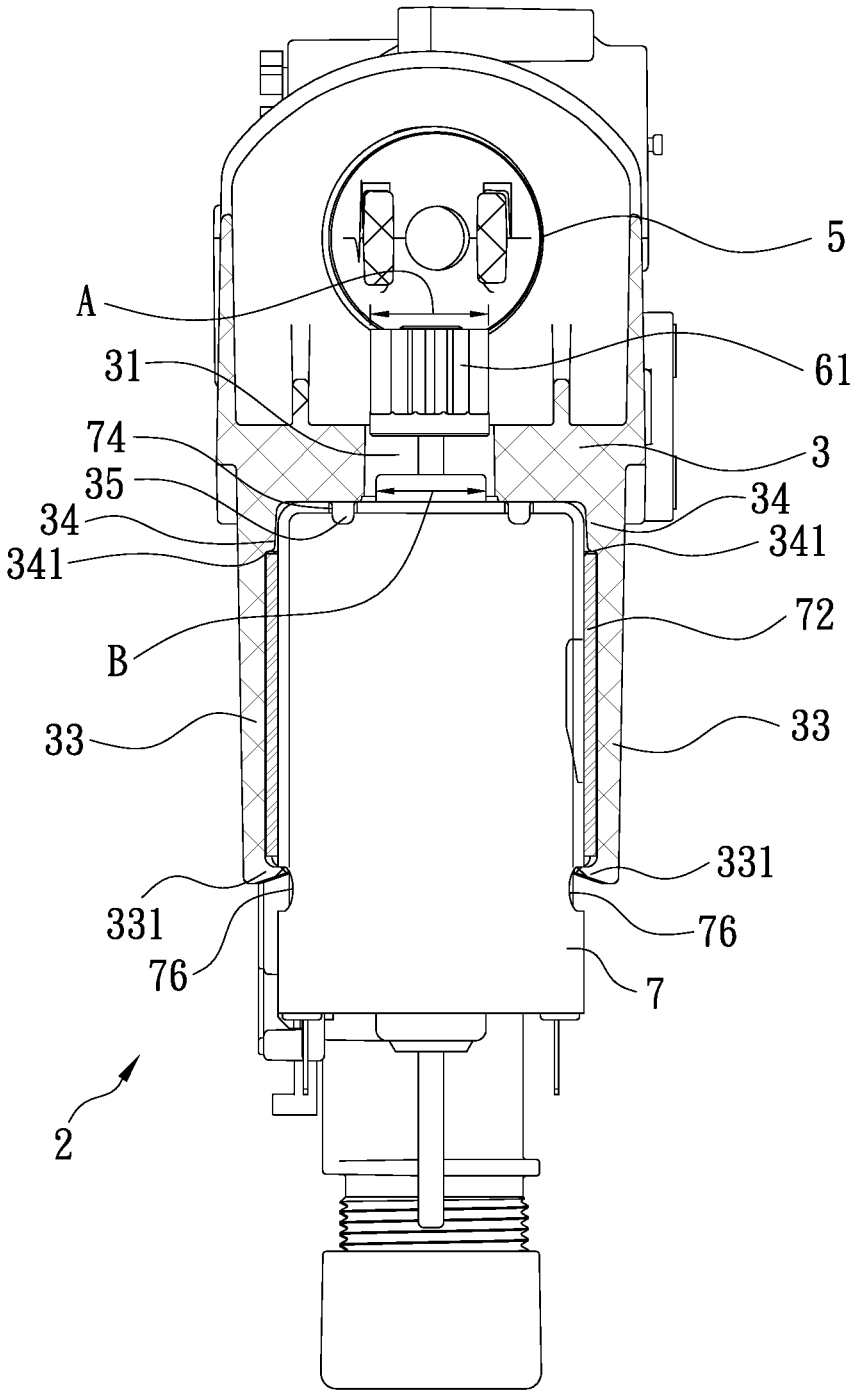
FIG. 5 is another cross sectional view showing the assembly of a part of the air compressor according to the first embodiment of the present invention.

The diameter A of the top of the small-diameter gear 61 is more than the outer diameter B of the bearing housing 71, as shown in FIG. 5.

A transmission mechanism 6 includes a large-diameter gear 62 having a counterweight block and meshing with the small-diameter gear 61, wherein the large-diameter gear 62 is connected with the bearing 37 via a connection rod (not shown), and the transmission mechanism 6 actuates the piston 5 to move in the cylinder 4 reciprocately so as to compress air.

Figure 4:
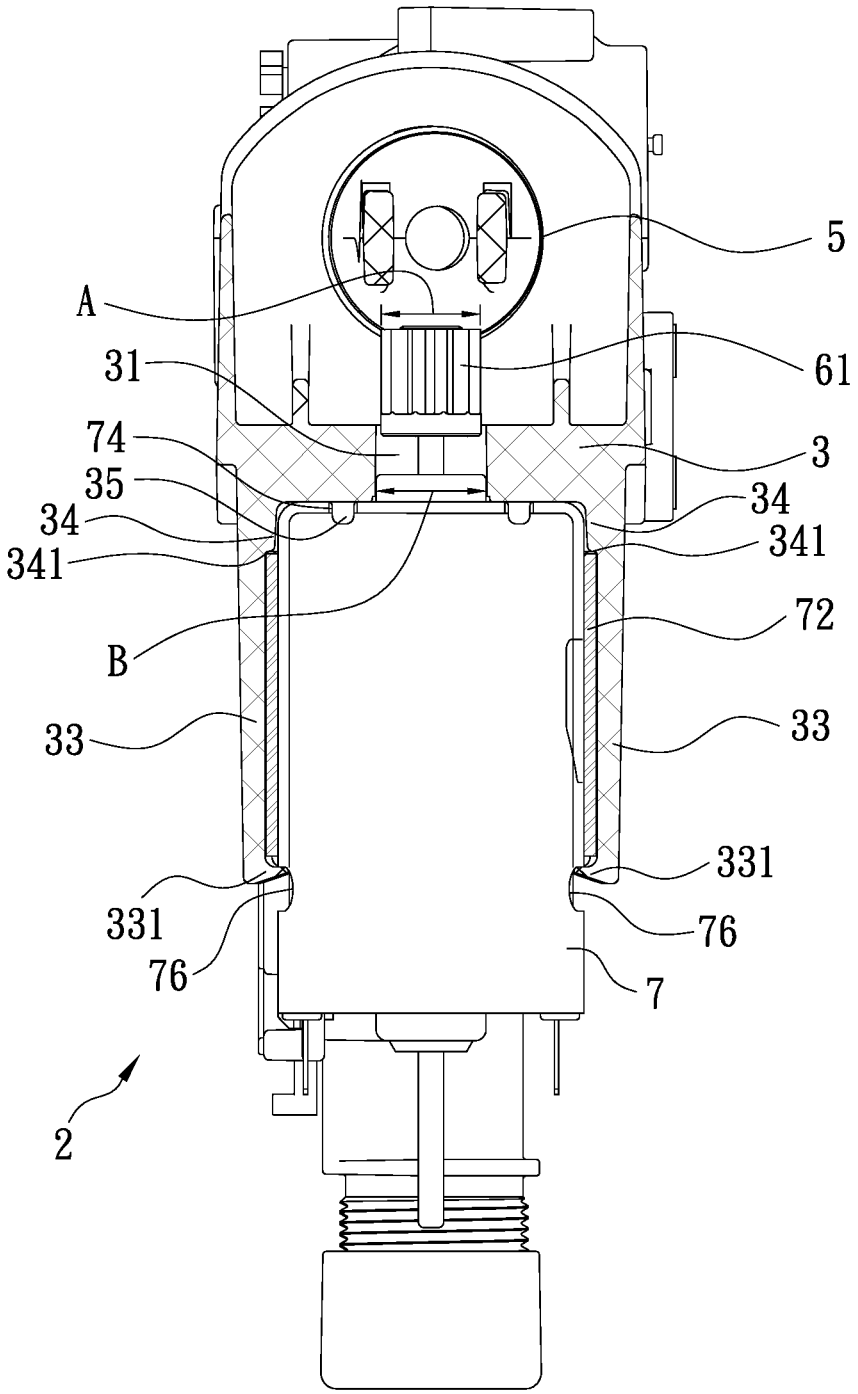
FIG. 4 is a cross sectional view showing the assembly of a part of the air compressor according to the first embodiment of the present invention.

Referring to FIGS. 2-4, the motor 7 includes two symmetrical air orifices 76 configured to circulate air inside and outside the motor 7, and the motor 7 includes multiple through orifices 74, 75 defined around a front face 70 of the motor 7, wherein the small-diameter gear 61 is fitted on the front face 70 of the motor 7. The base 3 includes two symmetrical elongated plates 33 extending from a rear end of the base 3, and the two symmetrical elongated plates 33 have two hooks 331 extending therefrom respectively. The base 3 further includes two symmetrical arcuate retainers 34 extending from two inner walls of the two symmetrical elongated plates 33 individually, multiple posts 35, 36 (as shown in FIG. 2) extending around the first locating orifice 31 of the base 3 and corresponding to the multiple through orifices 74, 75 respectively. When desiring to fix the motor 7 on the base 3, the multiple through orifices 74, 75 of the front face 70 are engaged on the multiple posts 35, 36 of the base 3 individually, and the bearing housing 71 of the front face 70 of the motor 7 is received in the first locating orifice 31 of the base 3, wherein an outer wall of the motor 7 is retained by the two symmetrical arcuate retainers 34 of the base 3. In the meantime, an end of the motor 7, fitted with the magnetic coil 72, abuts against two top faces 341 of the two symmetrical arcuate retainers 34, and the two hooks 331 of the two symmetrical elongated plates 33 of the base 3 are engaged with the motor 7, thus fixing the motor 7 on the base 3 securely.

As illustrated in FIGS. 1-4, the two hooks 331 of the two symmetrical elongated plates 33 of the base 3 are engaged with the two symmetrical air orifices 76 of the motor 7 respectively.

Figure 6:
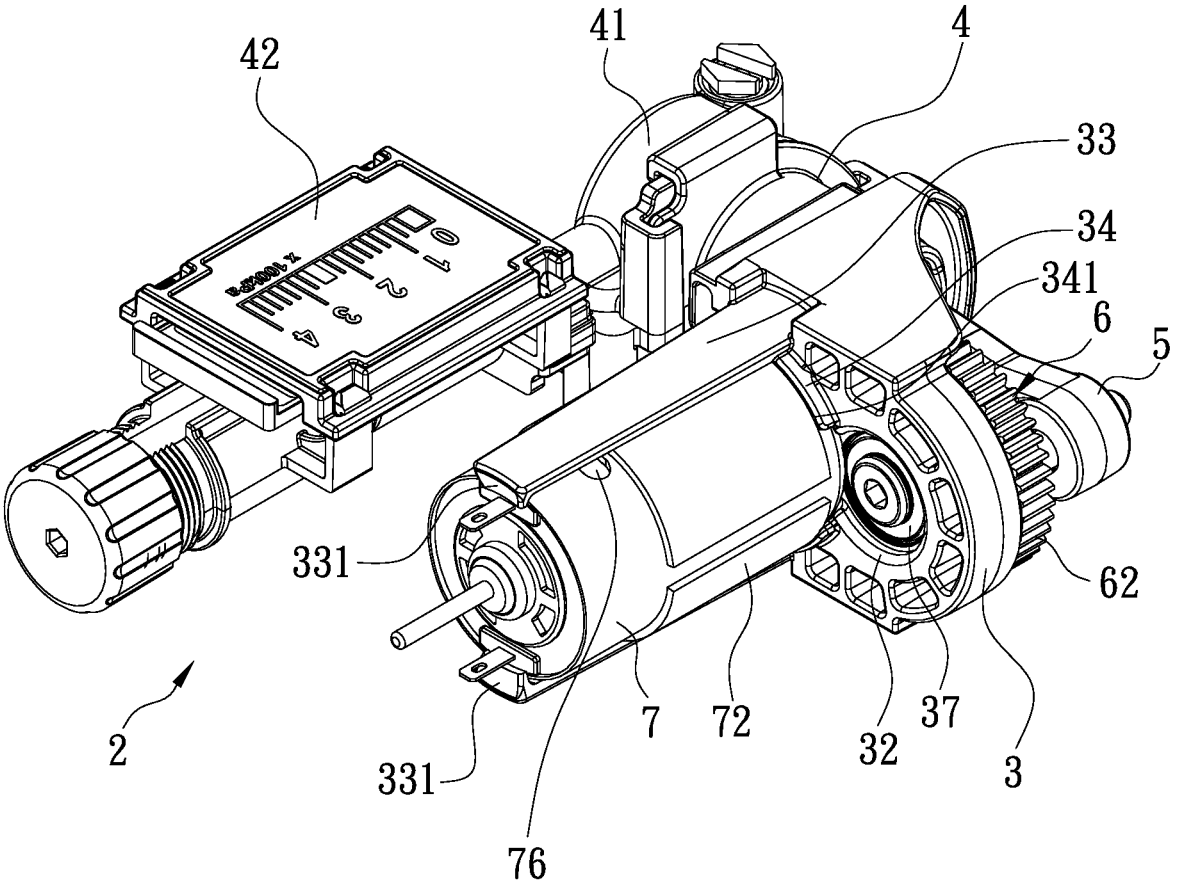
FIG. 6 is a perspective view showing the assembly of an air compressor according to a second embodiment of the present invention.
Figure 7:
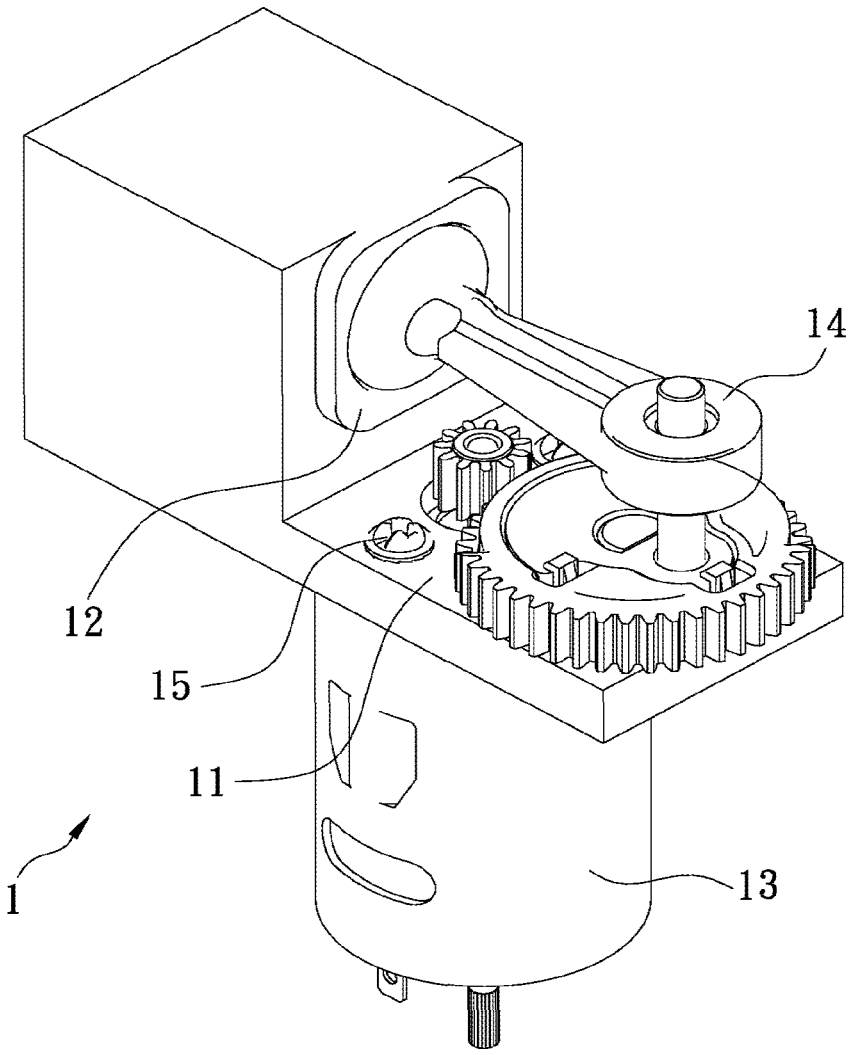
FIG. 7 PRIOR ART
FIG. 7 is a perspective view showing a motor of a conventional air compressor being fixed on a base by using screws.
Figure 8:
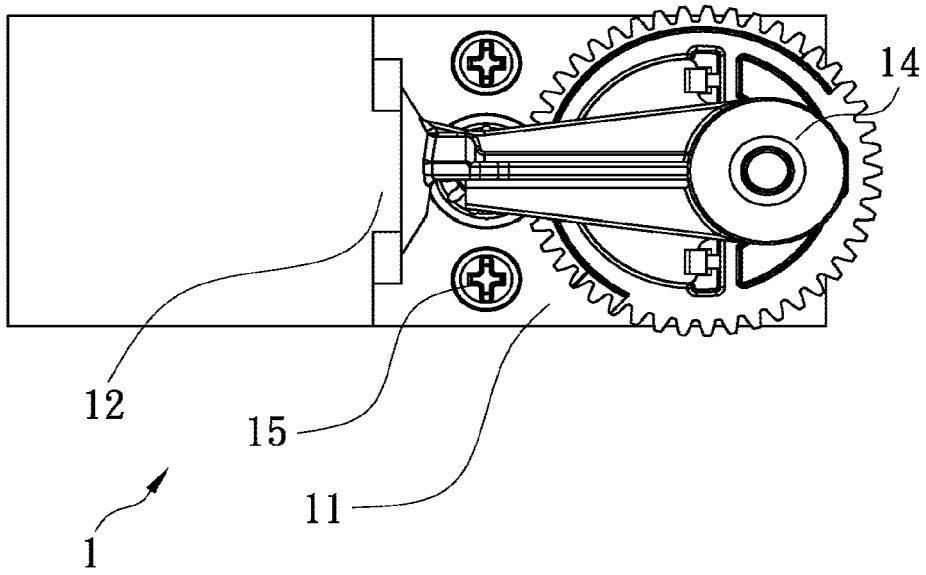
FIG. 8 PRIOR ART
FIG. 8 is a top plan view of FIG. 7.
Figure 9:
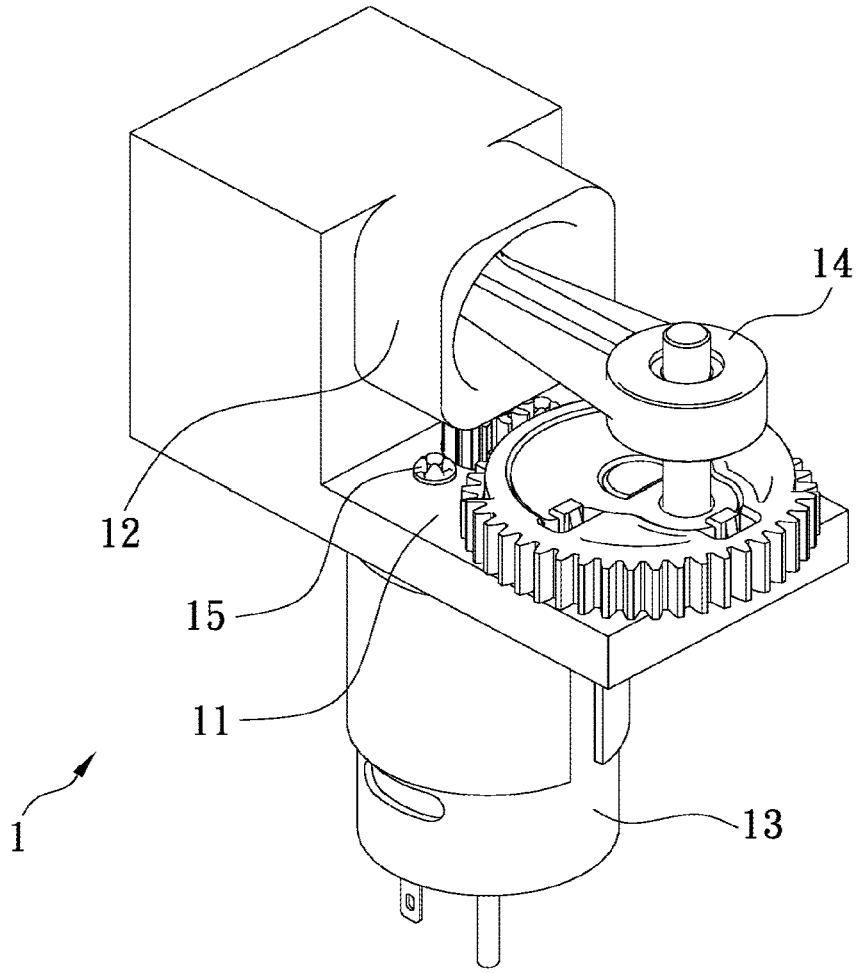
FIG. 9 PRIOR ART
FIG. 9 is a perspective view showing the motor of the conventional air compressor cannot be fixed on the base by using the screws because of a limitation space.
Figure 10:
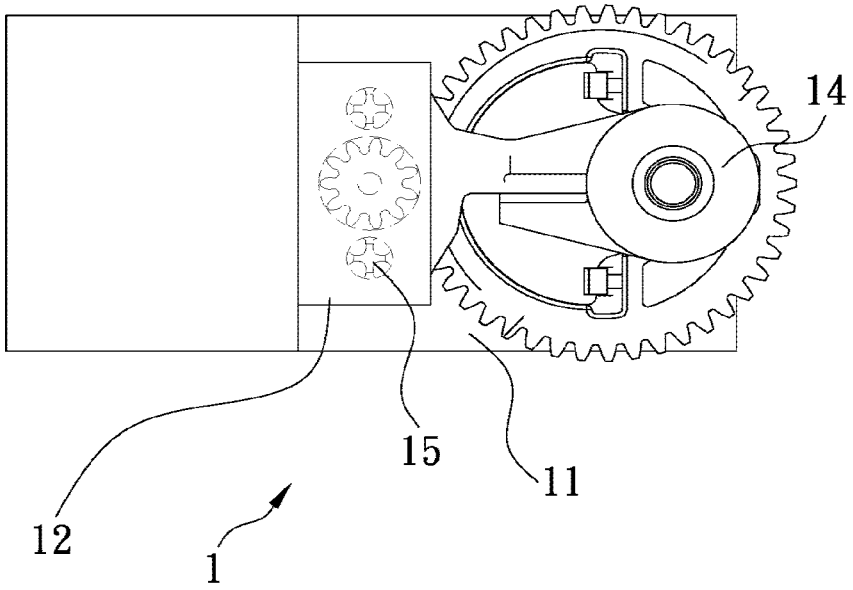
FIG. 10 PRIOR ART
FIG. 10 is a top plan view of FIG. 9.

Referring to FIG. 6, in a second embodiment, the two hooks 331 of the two symmetrical elongated plates 33 of the base 3 are engaged with a distal end of the motor 7.

Thereby, the multiple through orifices 74, 75 of the motor 7 are engaged on the multiple posts 35, 36 of the base 3 individually, and the bearing housing 71 of the front face 70 of the motor 7 is received in the first locating orifice 31 of the base 3, wherein the outer wall of the motor 7 is retained by the two symmetrical arcuate retainers 34 of the base 3. In the meantime, the end of the motor 7, fitted with the magnetic coil 72, abuts against two top faces 341 of the two symmetrical arcuate retainers 34, and the two hooks 331 of the two symmetrical elongated plates 33 of the base 3 are engaged with the motor 7, thus fixing the motor 7 on the base 3 securely.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A positioning structure of a motor of an air compressor comprising:

a base including a first locating orifice and a second locating orifice;

a cylinder connected to the base and including an air storage seat;

a motor fixed on the base, a smaller-diameter gear being inserted through the first locating orifice of the base and coupled to a central shaft of the motor, a bearing housing of the motor being accommodated in the first locating orifice; and a transmission mechanism actuating a piston to move in the cylinder reciprocatingly so as to compress air;

characterized in that:

the base includes two symmetrical elongated plates extending from a rear end of the base, and the two symmetrical elongated plates each having a respective hook extending therefrom, the base further including a respective symmetrical arcuate retainer axially extending from an inner wall of each of the two symmetrical elongated plates so that each arcuate retainer is axially wider than the respective elongated plate; and an outer wall of the motor is retained by the two symmetrical arcuate retainers of the base, and the two hooks of the two symmetrical elongated plates of the base are engaged with a magnetic material of the motor so that the motor is fixed on the base.

2. The positioning structure as claimed in claim 1, wherein the motor includes two symmetrical air orifices configured to circulate air inside and outside the motor, and the two hooks of the two symmetrical elongated plates of the base are engaged with the two symmetrical air orifices of the motor.

3. The positioning structure as claimed in claim 1, wherein a diameter of a top of the smaller-diameter gear is greater than an outer diameter of the bearing housing.

4. The positioning structure as claimed in claim 1, wherein the two hooks of the two symmetrical elongated plates of the base are engaged with a distal end of the motor.

5. The positioning structure as claimed in claim 1, wherein the magnetic material is a magnetic coil made of metal, and an end of the motor, fitted with the magnetic coil, abuts against two top faces of the two symmetrical arcuate retainers, and the outer wall of the motor is retained by the two symmetrical arcuate retainers of the base.

6. The positioning structure as claimed in claim 1, wherein a diameter of a top of the smaller-diameter gear is less than an outer diameter of the bearing housing, and the second locating orifice accommodates a bearing.

7. The positioning structure as claimed in claim 6, wherein the transmission mechanism includes a larger-diameter gear meshing with the smaller-diameter gear, and the larger-diameter gear is connected with the bearing.

8. The positioning structure as claimed in claim 7, wherein the motor includes multiple through orifices defined around a front face thereof, and the base further includes multiple posts extending around the first locating orifice radially between the arcuate retainers and the first locating orifice and corresponding to the multiple through orifices respectively.

* * * * *